US008970339B2

(12) United States Patent
Catalano

(10) Patent No.: US 8,970,339 B2
(45) Date of Patent: Mar. 3, 2015

(54) INTEGRATED MAGNETIC ASSEMBLIES AND METHODS OF ASSEMBLING SAME

(71) Applicant: General Electric Company, Schenectady, NY (US)

(72) Inventor: Robert James Catalano, Mesquite, TX (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/839,519

(22) Filed: Mar. 15, 2013

(65) Prior Publication Data

US 2014/0266558 A1 Sep. 18, 2014

(51) Int. Cl.

| | |
|---|---|
| ***H01F 27/24*** | (2006.01) |
| ***H01F 17/06*** | (2006.01) |
| ***H01F 17/04*** | (2006.01) |
| ***H01F 7/06*** | (2006.01) |
| ***H01F 41/02*** | (2006.01) |
| ***H01F 3/14*** | (2006.01) |

(52) U.S. Cl.

CPC . *H01F 41/02* (2013.01); *H01F 3/14* (2013.01)
USPC ..... 336/212; 336/178; 336/221; 29/606

(58) Field of Classification Search

USPC ..... 336/233, 221, 212, 192, 178; 29/606
See application file for complete search history.

(56) References Cited

U.S. PATENT DOCUMENTS

| | | | | |
|---|---|---|---|---|
| 5,574,420 | A * | 11/1996 | Roy et al. | 336/200 |
| 6,094,123 | A * | 7/2000 | Roy | 336/200 |
| 6,342,778 | B1 * | 1/2002 | Catalano et al. | 323/224 |
| 7,271,695 | B2 | 9/2007 | Wadlington et al. | |
| 7,390,449 | B2 * | 6/2008 | Ibata et al. | 264/157 |
| 7,525,406 | B1 * | 4/2009 | Cheng | 336/83 |
| 7,649,434 | B2 | 1/2010 | Xu et al. | |
| 7,821,375 | B2 | 10/2010 | Dong et al. | |
| 7,880,577 | B1 | 2/2011 | Glaser et al. | |
| 2004/0113741 | A1 * | 6/2004 | Li et al. | 336/212 |
| 2006/0192646 | A1 * | 8/2006 | Hanley | 336/200 |
| 2010/0013587 | A1 | 1/2010 | Yan et al. | |
| 2010/0039200 | A1 * | 2/2010 | Yan et al. | 336/147 |
| 2010/0176909 | A1 * | 7/2010 | Yasuda et al. | 336/233 |
| 2011/0090037 | A1 | 4/2011 | Tsai et al. | |
| 2012/0126888 | A1 | 5/2012 | Ikriannikov et al. | |

* cited by examiner

*Primary Examiner* — Mangtin Lian
(74) *Attorney, Agent, or Firm* — General Electric Company

(57) ABSTRACT

A magnetic core is provided. The magnetic core includes a magnetic base and a magnetic plate. The magnetic base includes a first U-core, a second U-core, and a spacing member. The first U-core has a relatively high magnetic permeability, and includes a first surface having a first winding channel defined therein. The second U-core has a relatively high magnetic permeability, and includes a second surface having a second winding channel defined therein. The first and second surfaces are substantially coplanar with one another. The spacing member is connected to the first and second U-cores such that a gap having a relatively low magnetic permeability is formed between the first and second U-cores. The magnetic plate is coupled to the magnetic base such that the magnetic plate substantially covers the first and second surfaces.

19 Claims, 8 Drawing Sheets

INTEGRATED MAGNETIC ASSEMBLIES AND METHODS OF ASSEMBLING SAME

BACKGROUND

The field of the embodiments relate generally to power electronics, and more particularly, to integrated magnetic assemblies for use in power electronics.

High density power electronic circuits often require the use of multiple magnetic electrical components for a variety of purposes, including energy storage, signal isolation, signal filtering, energy transfer, and power splitting. As the demand for higher power density electrical components increases, it becomes more desirable to integrate two or more magnetic electrical components, such as multiple inductors, into the same core or structure.

However, known integrated magnetic assemblies are sometimes not adequately configured to permit multiple windings to be manufactured on a single structure and operate independently of one another. As a result, separate cores or structures are used when multiple components are operated independently in a given electronics circuit, thereby increasing the number and size of the components needed for a given operation, and reducing the power density of a given electronics circuit.

Other known integrated magnetic assemblies do not permit flexibility in the positioning of the input and output portions of the windings used in such assemblies. Still other known integrated magnetic assemblies require a relatively complex and/or costly fabrication process.

BRIEF DESCRIPTION

In one aspect, a magnetic core is provided. The magnetic core includes a magnetic base and a magnetic plate. The magnetic base includes a first U-core, a second U-core, and a spacing member. The first U-core has a relatively high magnetic permeability, and includes a first surface having a first winding channel defined therein. The second U-core has a relatively high magnetic permeability, and includes a second surface having a second winding channel defined therein. The first and second surfaces are substantially coplanar with one another. The spacing member is connected to the first and second U-cores such that a gap having a relatively low magnetic permeability is formed between the first and second U-cores. The magnetic plate is coupled to the magnetic base such that the magnetic plate substantially covers the first and second surfaces.

In another aspect, an integrated magnetic assembly is provided. The integrated magnetic assembly includes a magnetic core, a first winding, and a second winding. The magnetic core includes a first U-core, a second U-core, and a spacing member. The first U-core has a relatively high magnetic permeability, and includes a first surface. The second U-core has a relatively high magnetic permeability, and includes a second surface. The first and second surfaces are substantially coplanar with one another. The spacing member is connected to the first and second U-cores such that a gap having a relatively low magnetic permeability is formed between the first and second U-cores. The magnetic plate is coupled to the magnetic base such that the magnetic plate substantially covers the first and second surfaces. The first winding includes a first section recessed within the first surface, and is inductively coupled to the first U-core. The second winding includes a second section recessed within the second surface, and is inductively coupled to the second U-core.

In yet another aspect, a method of assembling an integrated magnetic assembly is described. The method includes providing a magnetic base within a magnetic core, the magnetic base including a first U-core having a relatively high magnetic permeability, a second U-core having a relatively high magnetic permeability, and a spacing member, the first U-core including a first surface and the second U-core including a second surface, providing a magnetic plate within the magnetic core, connecting the spacing member to the first U-core and the second U-core such that the first and second surfaces are substantially coplanar and a gap having a relatively low magnetic permeability is formed between the first and second U-cores, and coupling the magnetic plate to the magnetic base such that the magnetic plate substantially covers the first and second surfaces.

Although specific features of various embodiments may be shown in some drawings and not in others, this is for convenience only. Any feature of any drawing may be referenced and/or claimed in combination with any feature of any other drawing.

DETAILED DESCRIPTION

Exemplary embodiments of integrated magnetic assemblies are described herein. A magnetic core includes a magnetic base and a magnetic plate. The magnetic base includes a first U-core, a second U-core, and a spacing member. The first U-core has a relatively high magnetic permeability, and includes a first surface having a first winding channel defined therein. The second U-core has a relatively high magnetic permeability, and includes a second surface having a second winding channel defined therein. The first and second surfaces are substantially coplanar with one another. The spacing member is connected to the first and second U-cores such that a gap having a relatively low magnetic permeability is formed between the first and second U-cores. The magnetic plate is coupled to the magnetic base such that the magnetic plate substantially covers the first and second surfaces.

Figure 1:
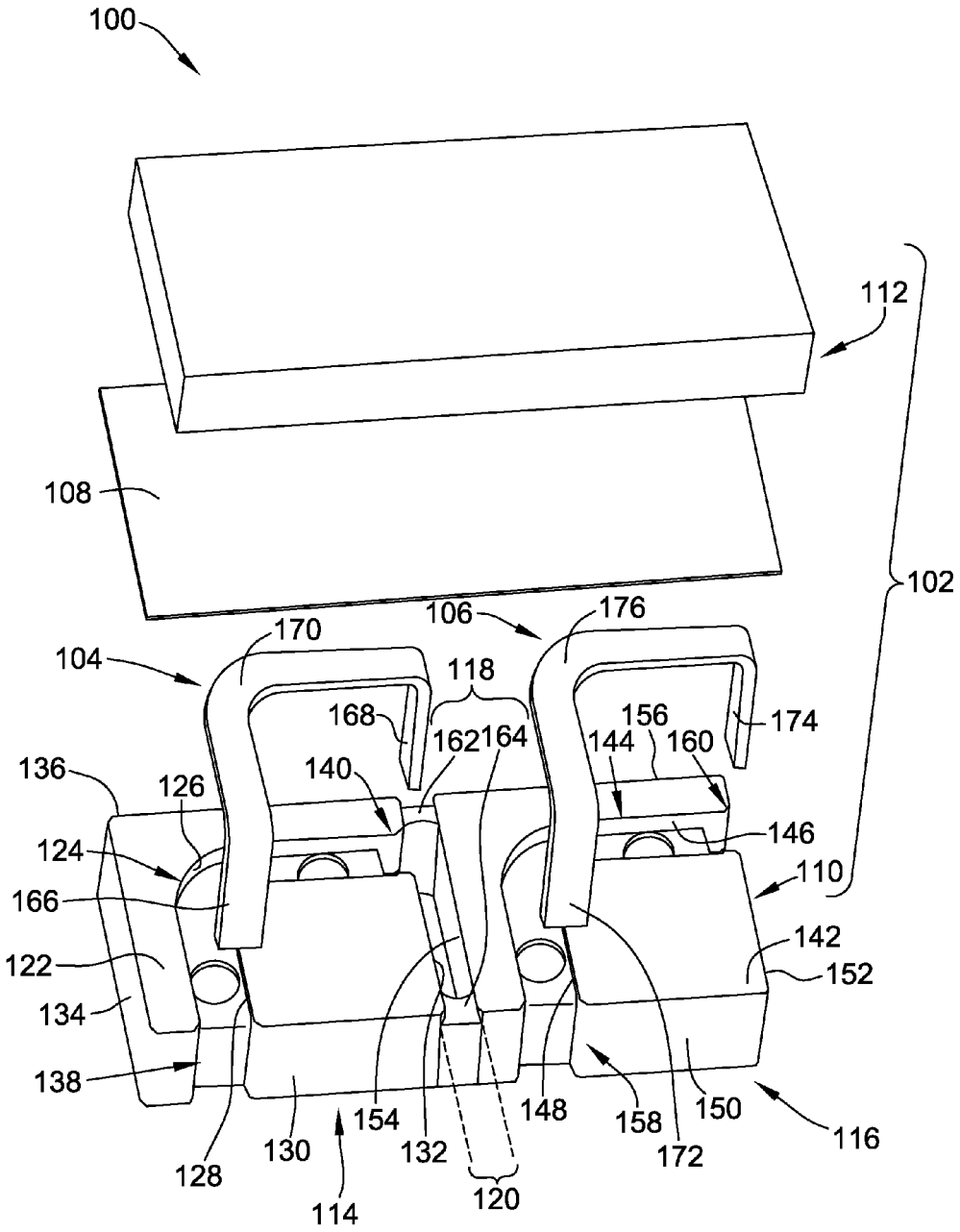
FIG. 1 is an exploded view of an exemplary integrated magnetic assembly including a magnetic core.

The embodiments described herein include cost effective integrated magnetic assemblies having multiple windings capable of operating independently of one another. FIG. 1 is an exploded view of an exemplary integrated magnetic assembly 100. In the exemplary embodiment, integrated magnetic assembly 100 includes a magnetic core 102, a first winding 104 inductively coupled to magnetic core 102, a second winding 106 inductively coupled to magnetic core 102, and a buffering layer 108.

Figure 2:
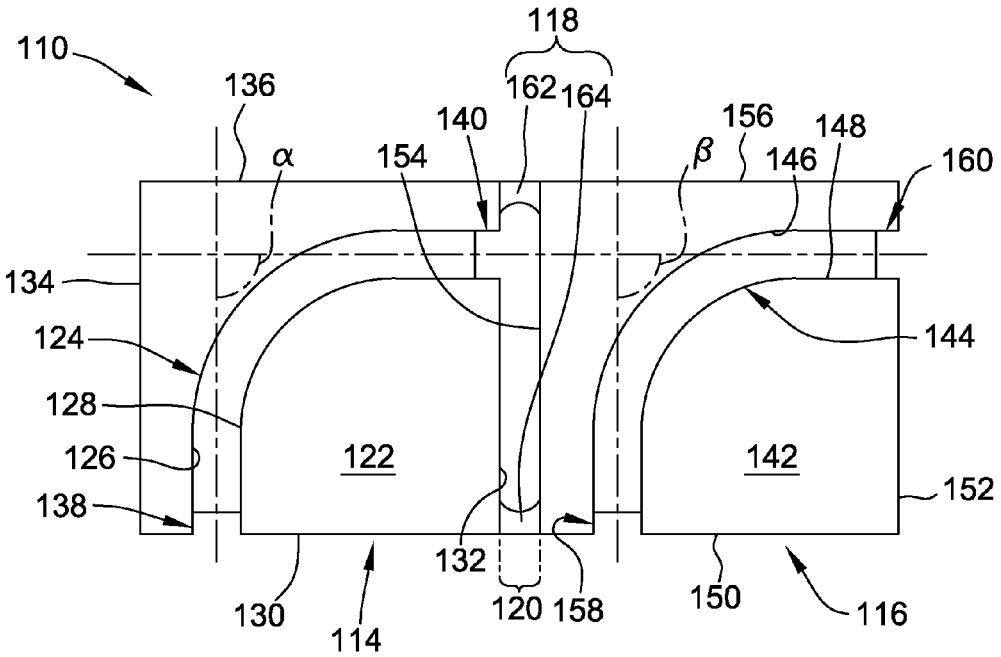
FIG. 2 is a top view of the magnetic core shown in FIG. 1 with certain features removed for illustration.

Magnetic core 102 includes a magnetic base 110 and a magnetic plate 112 coupled to magnetic base 110. Magnetic base 110 includes a first U-core 114 and a second U-core 116 each having a relatively high magnetic permeability, such as between about 1,500 to 10,000 microhenrys per meter, and a spacing member 118 connecting first and second U-cores 114 and 116 such that a gap 120 (also shown in FIGS. 2 and 3) of relatively low magnetic permeability, such as between about 40 and 500 microhenrys per meter, is formed between first and second U-cores 114 and 116. In alternative embodiments, either or both of first U-core 114 and second U-core 116 may have a relatively low magnetic permeability, such as between about 40 to 500 microhenrys per meter.

Figure 3:
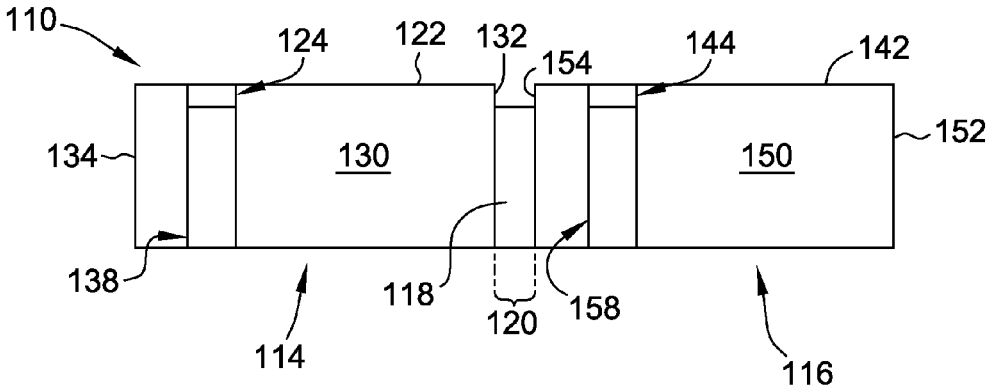
FIG. 3 is a side view of the magnetic core shown in FIG. 1 with certain features removed for illustration.

First U-core 114 includes a first surface 122 having a first winding channel 124 defined therein, giving first U-core 114 the appearance of a "U" shape when viewed from the side, as shown in FIG. 3. First winding channel 124 is configured to receive and inductively couple a conductive winding, such as first winding 104, to first U-core 114. First winding channel 124 is partially defined by winding channel sidewalls 126 and 128 that are substantially parallel with each other along the length of first winding channel 124.

In the exemplary embodiment, first winding channel 124 is bent at an angle α (shown in FIG. 2) of about 90 degrees. In alternative embodiments, the angle α at which first winding channel 124 is bent may be any angle that enables the integrated magnetic assembly 100 to function as described herein, such as between about 60 degrees and about 120 degrees, between about 30 degrees and about 150 degrees, or even between about zero degrees and about 180 degrees. In the exemplary embodiment, first winding channel 124 includes a single bend. In alternative embodiments, winding channel may include any number of bends that enables integrated magnetic assembly 100 to function as described herein. Advantageously, the potential inductance of first U-core 114 can be varied by increasing the length of first winding channel 124 along first surface 122 of first U-core 114. For example, the length of first winding channel 124 may be increased or decreased by adjusting either or both of the angle α at which first winding channel 124 is bent and the number of bends in first winding channel 124.

First U-core 114 also includes a plurality of outer surfaces 130, 132, 134, and 136 adjoining first surface 122, including a front outer surface 130 and a side outer surface 132. In the exemplary embodiment front outer surface 130 and side outer surface 132 are adjoining surfaces. One or more outer surfaces 130, 132, 134, and 136 may have one or more winding channels defined therein. In the exemplary embodiment, front outer surface 130 includes a first terminal winding channel 138 defined therein and connected to first winding channel 124. Side outer surface 132 includes a second terminal winding channel 140 defined therein and connected to first winding channel 124. First terminal winding channel 138 extends in a direction substantially perpendicular to first surface 122. Second terminal winding channel 140 also extends in a direction substantially perpendicular to first surface 122. Second terminal winding channel 140 also extends between first and second U-cores 114 and 116.

Second U-core 116 similarly includes a second surface 142 having a second winding channel 144 defined therein. In the exemplary embodiment, second surface 142 of second U-core 116 is substantially coplanar with first surface 122 of first U-core 114. In alternative embodiments, second surface 142 of second U-core 116 may be disposed in a different plane than first surface 122 of first U-core 114. Second winding channel 144 is configured to receive and inductively couple a conductive winding, such as second winding 106, to second U-core 116. Second winding channel 144 is partially defined by winding channel sidewalls 146 and 148 that are substantially parallel with each other along the length of second winding channel 144.

In the exemplary embodiment, second winding channel 144 is bent at an angle β (shown in FIG. 2) of about 90 degrees. In alternative embodiments, the angle β at which second winding channel 144 is bent may be any angle that enables the integrated magnetic assembly 100 to function as described herein, such as between about 60 degrees and about 120 degrees, between about 30 degrees and about 150 degrees, or even between about zero degrees and about 180 degrees. In the exemplary embodiment, second winding channel 144 includes a single bend. In alternative embodiments, winding channel may include any number of bends that enables integrated magnetic assembly 100 to function as described herein. Advantageously, the potential inductance of second U-core 116 can be varied by increasing or decreasing the length of second winding channel 144 along second surface 142 of second U-core 116. For example, the length of second winding channel 144 may be increased or decreased by adjusting either or both of the angle 3 at which second winding channel 144 is bent and the number of bends in second winding channel 144.

Second U-core 116 also includes a plurality of outer surfaces 150, 152, 154, and 156 adjoining second surface 142, including a front outer surface 150 and a side outer surface 152. In the exemplary embodiment front outer surface 150 and side outer surface 152 are adjoining surfaces. One or more outer surfaces 150, 152, 154, and 156 may have one or more winding channels defined therein. In the exemplary embodiment, front outer surface 150 includes a third terminal winding channel 158 defined therein and connected to second winding channel 144. Side outer surface 152 includes a fourth terminal winding channel 160 defined therein and connected to second winding channel 144. Third terminal winding channel 158 extends in a direction substantially perpendicular to second surface 142. Fourth terminal winding channel 160 also extends in a direction substantially perpendicular to second surface 142.

In the exemplary embodiment, first and second winding channels 124 and 144 defined within first and second U-cores 114 and 116 have substantially the same configuration (i.e., a single bend of about 90 degrees). In alternative embodiments, first and second winding channels 124 and 144 may have different configurations from one another, for example, by having bends with different angles, by having a different number of bends, or both. In yet further alternative embodiments, the inductive winding assemblies formed within first and second U-cores 114 and 116 may have different operational characteristics from one another, such as different inductances, different DC currents, and different operating frequencies.

In the exemplary embodiment, first and second U-cores 114 and 116 have generally square cross-sections. In alternative embodiments, first or second U-cores 114 and 116 may have a rectangular, circular, elliptical, or polygonal cross-section. In yet further embodiments, first or second U-cores 114 and 116 may have any other shaped cross-section that enables integrated magnetic assembly 100 to function as described herein.

First and second U-cores 114 and 116 are connected by spacing member 118 disposed between first and second U-cores 114 and 116. Spacing member 118 is connected to first and second U-cores 114 and 116 such that a gap 120 (also shown in FIGS. 2 and 3) of relatively low magnetic permeability is formed between first and second U-cores 114 and 116. In the exemplary embodiment, spacing member 118 includes a first section 162 and a second section 164 disposed at opposite ends of gap 120 between first and second U-cores 114 and 116. In this configuration, spacing member 118 acts as a magnetic flux bridge between first U-core 114 and second U-core 116, providing a continuous magnetic flux path through magnetic core 102 for orthogonal flux (i.e., magnetic flux generated by a winding that is orthogonal to the primary flux path within magnetic core 102) produced by a winding inductively coupled to first U-core 114. In alternative embodiments, first U-core 114, second U-core 116, and spacing member 118 may be configured such that spacing member 118 acts as a magnetic flux bridge for orthogonal flux produced by a winding inductively coupled to second U-core 116. Providing a continuous magnetic flux path through magnetic core 102 for orthogonal flux produced by a winding inductively coupled to first U-core 114 increases the inductance of the winding assembly formed within first U-core 114 at low currents.

In the exemplary embodiment, spacing member 118 is constructed of the same material as first and second U-cores 114 and 116 (i.e., ferrite). In alternative embodiments, spacing member 118 may be constructed from a material having a relatively low magnetic permeability, and first and second U-cores 114 and 116 may be constructed of a material having a relatively high magnetic permeability. In yet further alternative embodiments, spacing member 118 may be constructed from a material having a relatively high magnetic permeability, and first and second U-cores 114 and 116 may be constructed of a material having a relatively low magnetic permeability. In yet further alternative embodiments, the size and/or shape of spacing member 118, including first and second sections 162 and 164, may be any suitable size and/or shape that enables integrated magnetic assembly 100 to operate as described herein. In yet further alternative embodiments, the location(s) at which spacing member 118 connects first and second U-cores 114 and 116 may be any location(s) between first and second U-cores 114 and 116 that enables integrated magnetic assembly 100 to function as described herein.

In the exemplary embodiment, magnetic base 110 is machined from a single piece of magnetic material, such as ferrite. First U-core 114, second U-core 116, and spacing member 118 thus comprise a unitary magnetic base. In alternative embodiments, magnetic base 110 may be formed from ferrite polymer composites, powdered iron, sendust, laminated cores, tape wound cores, silicon steel, nickel-iron (e.g., MuMETAL®), amorphous metals, or any other suitable material that enables integrated magnetic assembly 100 to function as described herein. In yet further alternative embodiments, first U-core 114, second U-core 116, and/or spacing member 118 may be joined together from multiple pieces that are fabricated separately from the same materials or from different materials.

Magnetic plate 112 is coupled to magnetic base 110 such that magnetic plate 112 substantially covers first and second surfaces 122 and 142. Magnetic plate 112 thereby provides a continuous magnetic flux path through magnetic core 102 for first and second U-cores 114 and 116. In the exemplary embodiment, magnetic plate 112 comprises a generally solid rectangular plate. In alternative embodiments, magnetic plate 112 may have a generally square, circular, elliptical, or polygonal shape. In yet further embodiments, magnetic plate 112 may have any other shape that enables integrated magnetic assembly 100 to function as described herein. In yet further alternative embodiments, magnetic plate 112 may have one or more holes, notches, voids or gaps defined therein. In the exemplary embodiment, magnetic plate 112 is machined from a single piece of magnetic material, such as ferrite. In alternative embodiments, magnetic base 112 may be formed from ferrite polymer composites, powdered iron, sendust, laminated cores, tape wound cores, silicon steel, nickel-iron (e.g., MuMETAL®), amorphous metals, molded and extruded magnetic materials, such as magnetic foils or magnetic shielding tape, or any other suitable material that enables integrated magnetic assembly 100 to function as described herein. In alternative embodiments, magnetic plate 112 is formed from multiple pieces that are fabricated separately from the same materials or from different materials First winding 104 is inductively coupled to first U-core 114. First winding 104 is configured to be received within first winding channel 124. In the exemplary embodiment, first winding 104 is bent at substantially the same angle as first winding channel 124.

First winding 104 includes a first terminal side 166, a second terminal side 168, and an inductive section 170 interposed between first and second terminal sides 166 and 168. Inductive section 170 of first winding 104 is recessed within first surface 122. In the exemplary embodiment, first terminal side 166 is recessed within front outer surface 130, and second terminal side 168 is recessed within side outer surface 132. In alternative embodiments, first and second terminal sides 166 may both be recessed within the same surface, such as front outer surface 130 or side outer surface 132.

Second winding 106 is inductively coupled to second U-core 116. Second winding 106 is configured to be received within second winding channel 144. In the exemplary embodiment, second winding 106 is bent at substantially the same angle as second winding channel 144.

Second winding 106 includes a third terminal side 172, a fourth terminal side 174, and an inductive section 176 interposed between third and fourth terminal sides 172 and 174. Inductive section 176 of second winding 106 is recessed within second surface 142. In the exemplary embodiment, third terminal side 172 is recessed within front outer surface 150 and fourth terminal side 174 is recessed within side outer surface 152. In alternative embodiments, third and fourth terminal sides 172 and 174 may both be recessed within the same surface, such as front outer surface 150 or side outer surface 152.

In the exemplary embodiment, second winding 106 has substantially the same configuration and orientation as first winding 104, although multiple orientations of first winding 104 and/or second winding 106 with respect to each other and with respect to magnetic core 102 are possible.

In the exemplary embodiment, first and second windings 104 and 106 are formed from layered conductive sheets, such as copper, although any other suitable conductive material may be used for first or second windings 104 and 106 that enables integrated magnetic assembly 100 to function as described herein.

In the exemplary embodiment, buffering layer 108 is a thin, planar layer made of a high-heat resistive material, such as Nomex® or polyimide. In alternative embodiments, buffering layer 108 may be made of any material that enables integrated magnetic assembly 100 to function as described herein. In yet further embodiments, buffering layer 108 may be omitted from integrated magnetic assembly 100.

Figure 4:
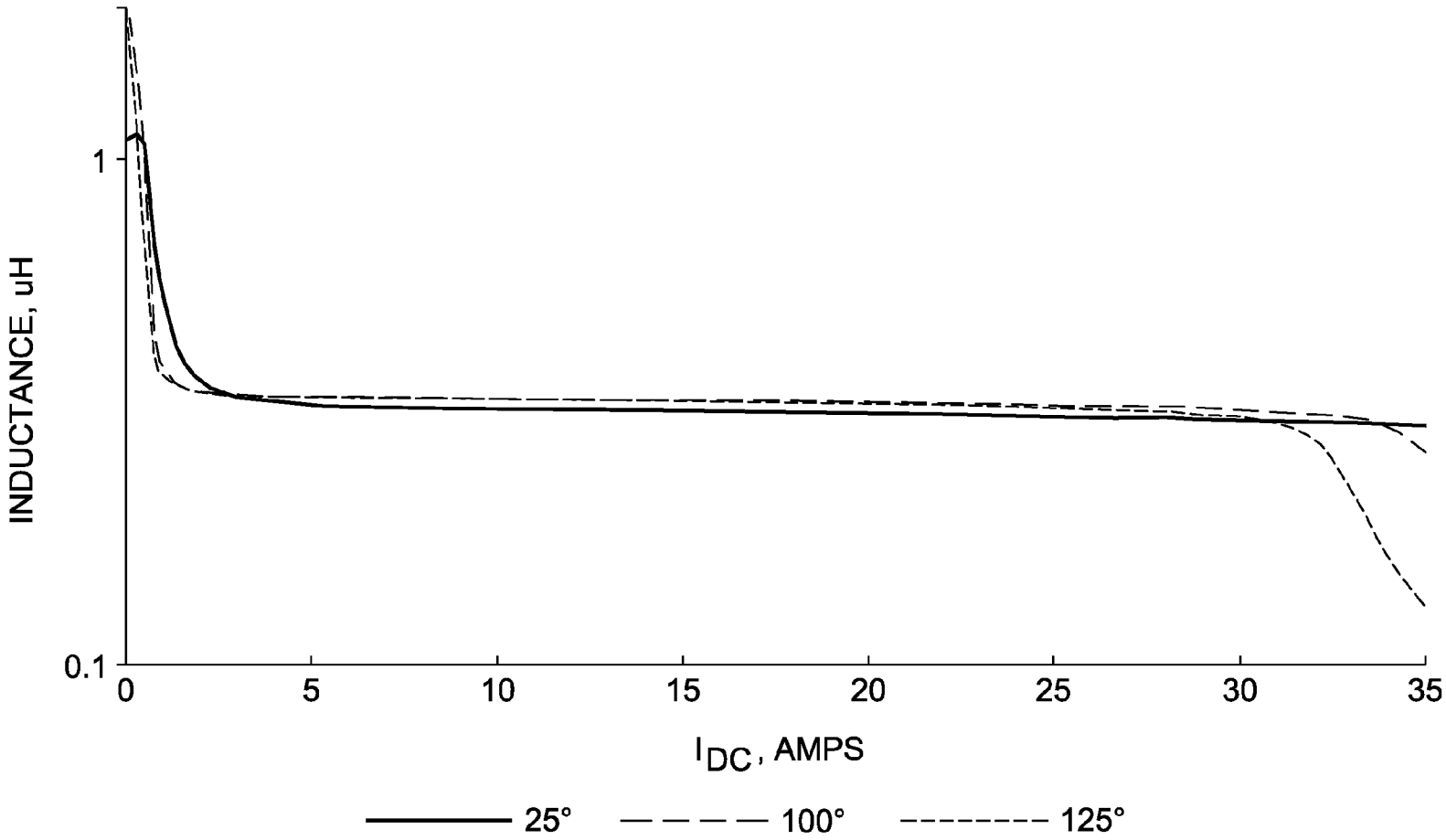
FIG. 4 is a plot of inductance versus current in an inductive winding assembly in the integrated magnetic assembly shown in FIG. 1.

FIG. 4 is a plot illustrating how the inductance of the first winding assembly (i.e., the winding assembly formed by first U-core 114 and first winding 104) of integrated magnetic assembly 100 varies as the current applied to first winding 104 increases for various operating temperatures. In the exemplary embodiment, the inductance of the first winding assembly is between about 0.3 μH and 0.4 μH at currents of between about 2 amps and about 30 amps. At lower currents (e.g., less than about 2 amps), the inductance of the first winding assembly is much higher. For example, at currents of about 0.5 amps, the inductance of the first winding assembly is about 1 μH, or about three to four times higher than the inductance of the first winding assembly at higher currents. In alternative embodiments, the current value at which the inductance of the first winding assembly begins to decrease (about 0.5 amps in the exemplary embodiment) can be varied by adjusting the permeability of the magnetic flux path between first U-core 114 and second U-core 116 formed by spacing member 118. For example, the magnetic flux path between first U-core and second U-core can be varied by changing the size, shape, position, and/or the magnetic permeability of spacing member 118.

Figure 5:
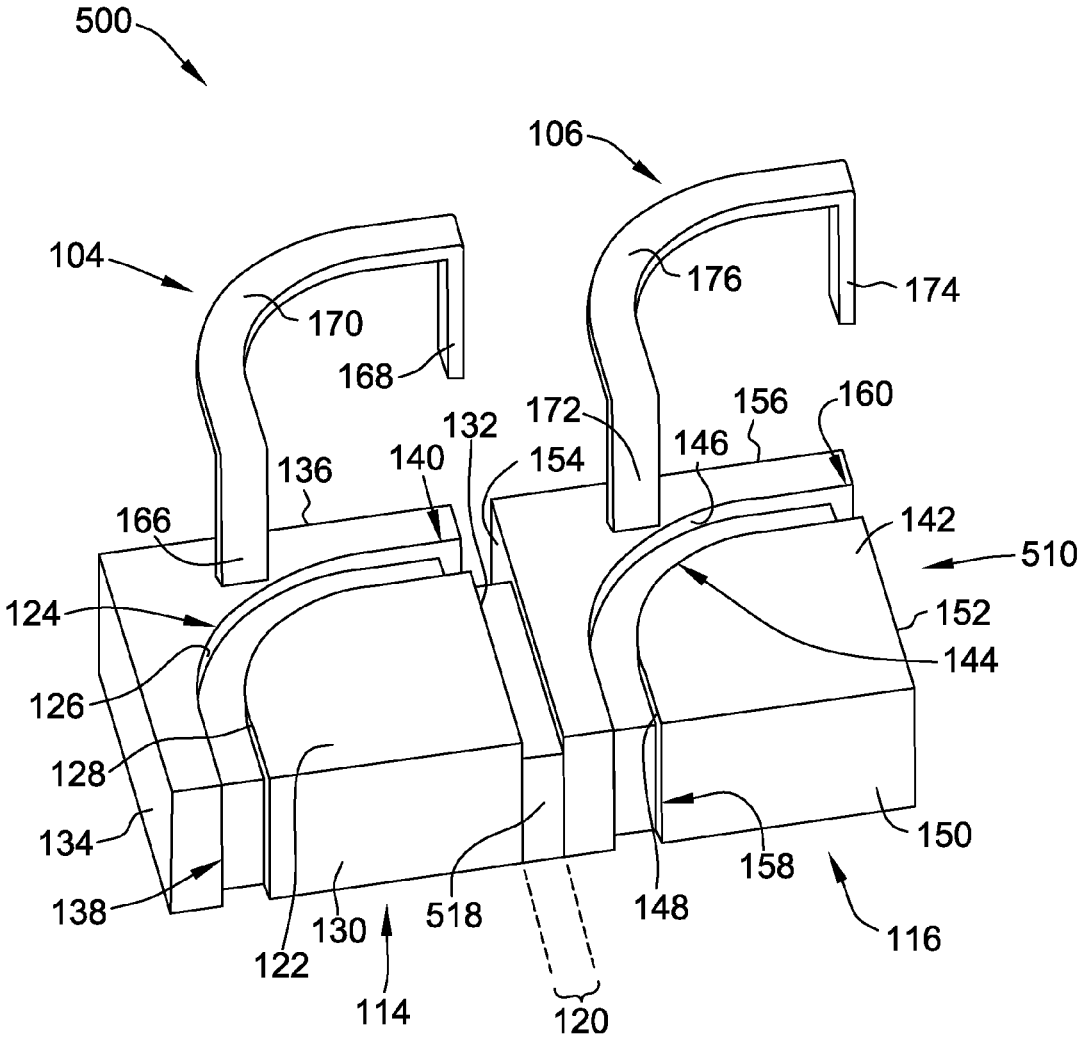
FIG. 5 is an exploded view of an alternative integrated magnetic assembly, including a magnetic base.
Figure 6:
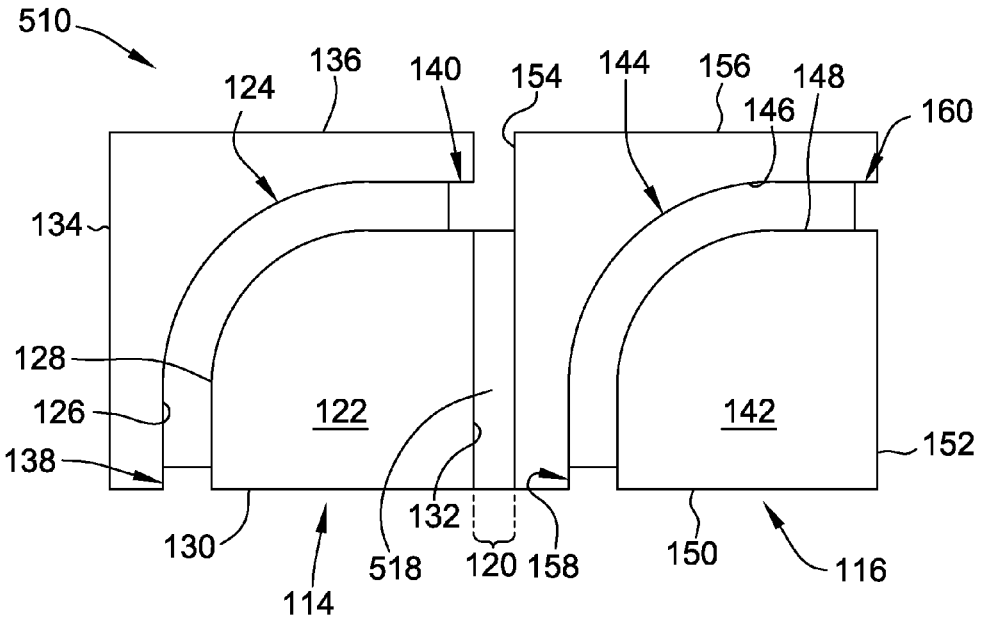
FIG. 6 is a top view of the magnetic base shown in FIG. 5.
Figure 7:
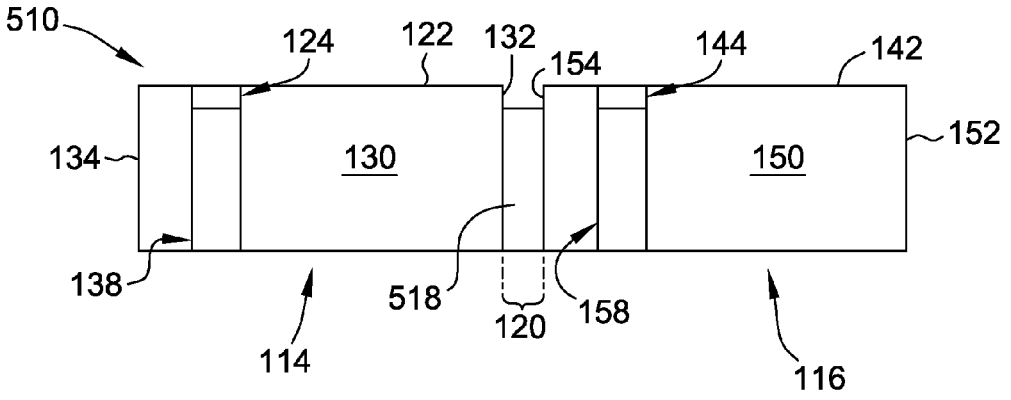
FIG. 7 is a side view of the magnetic base shown in FIG. 5.

FIG. 5 is an exploded view of an alternative embodiment of an integrated magnetic assembly 500. Unless specified, integrated magnetic assembly 500 is substantially similar to integrated magnetic assembly 100 (shown in FIG. 1). Magnetic plate 112 and buffering layer 108 are omitted for clarity. FIGS. 6 and 7 are, respectively, top and front views of magnetic base 510 shown in FIG. 5. In integrated magnetic assembly 500, first U-core 114 and second U-core have substantially the same magnetic permeability. Spacing member 518 is disposed on a single side second terminal winding channel 140. As a result, no continuous magnetic flux path is formed between first and second U-cores 114 and 116 through which orthogonal flux can flow. As a result, the inductance of the winding assembly formed within first U-core 114 will be substantially the same at lower currents as it is at higher currents when compared to integrated magnetic assembly 100. Additionally, first and second U-cores 114 and 116 may be operated independently of one another, despite having substantially the same magnetic permeability.

Figure 8:
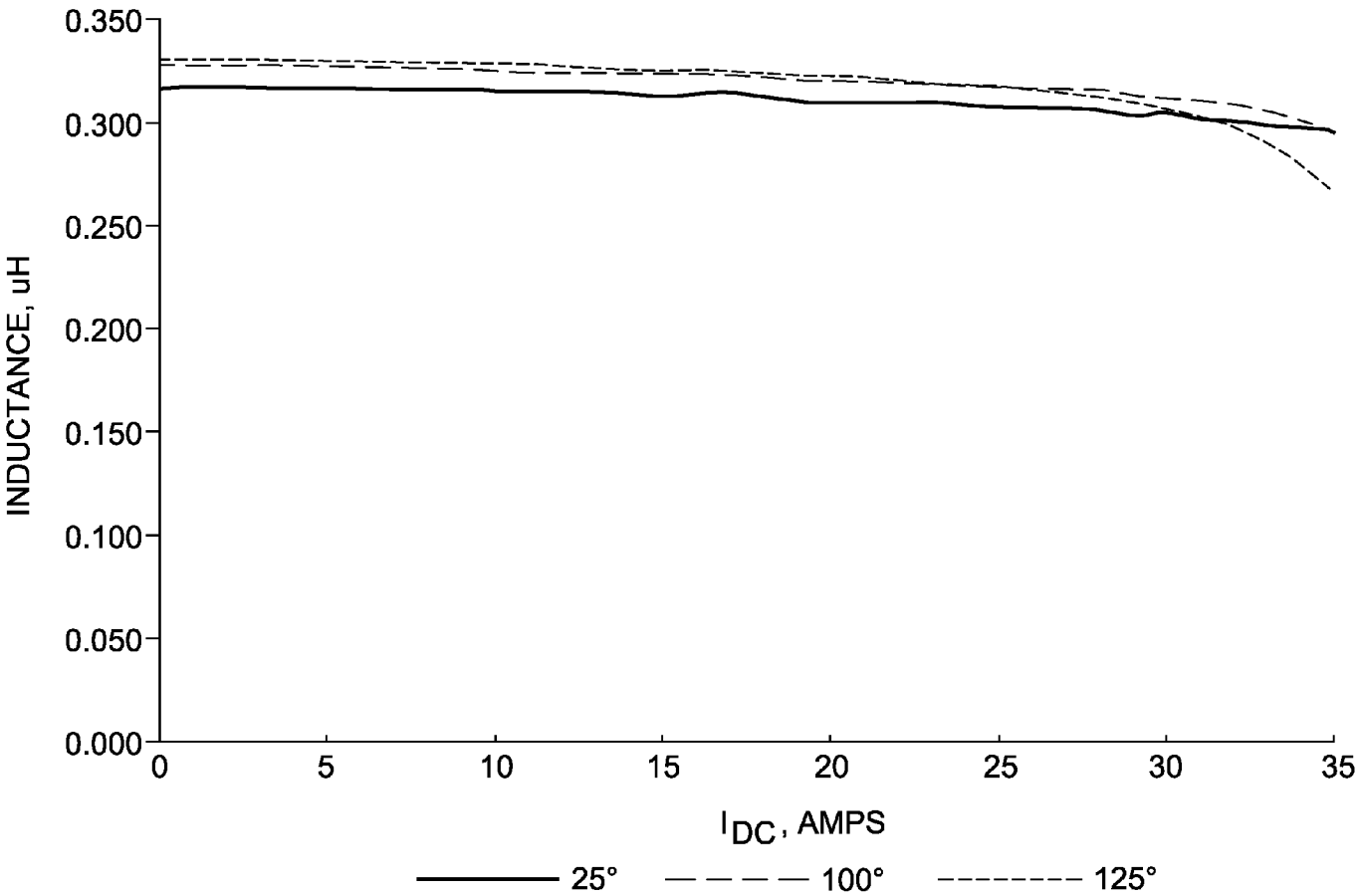
FIG. 8 is a plot of inductance versus current in an inductive winding assembly in the integrated magnetic assembly shown in FIG. 5.

FIG. 8 is a plot illustrating how the inductance of the first winding assembly (i.e., the winding assembly formed by first U-core 114 and first winding 104) of integrated magnetic assembly 500 varies as the current applied to first winding 104 increases for various operating temperatures. As shown in FIG. 8, the inductance of the first winding assembly is relatively constant with changing current when compared to the first winding assembly of integrated magnetic assembly 100.

In the exemplary embodiment, integrated magnetic assembly 100 is implemented in a multi-phase power converter, such as a multi-phase synchronous buck controller. Alternatively, integrated magnetic assembly 100 may be implemented in a multi-output power converter, such as a dual-output synchronous buck controller, or any other electrical architecture that enables integrated magnetic assembly 100 to function as described herein.

Figure 9:
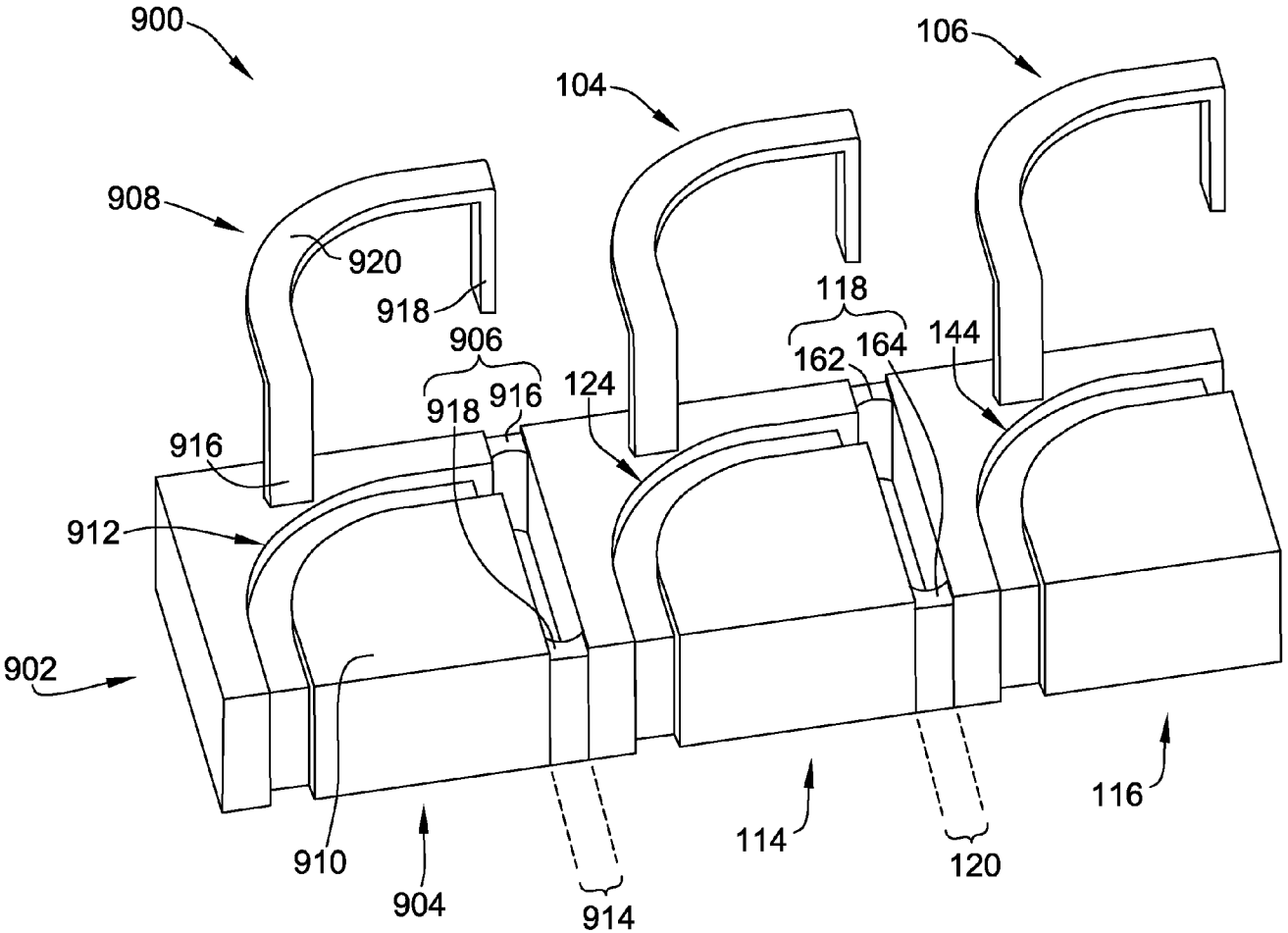
FIG. 9 is an exploded view of an alternative integrated magnetic assembly.

FIG. 9 is an exploded view of an alternative integrated magnetic assembly 900. Unless specified, integrated magnetic assembly 900 is substantially similar to integrated magnetic assembly 100 (shown in FIG. 1). Magnetic plate 112 and buffering layer 108 are omitted for clarity. In integrated magnetic assembly 900, a magnetic base 902 includes a third U-core 904, a second spacing member 906, and a third winding 908. Third U-core 904 includes a third surface 910 having a third winding channel 912 defined therein. Third surface 910 is substantially coplanar with first and second surfaces 122 and 142 of first and second U-cores 114 and 116.

In the embodiment shown in FIG. 9, third winding channel 912 has substantially the same configuration as first and second winding channels 124 and 144 (i.e., a single bend of about 90 degrees). In alternative embodiments, third winding channel 912 may have a different configuration from one or both of first and second winding channels 124 and 144, for example, by having a bend with a different angle, by having a different number of bends, or both.

In the embodiment shown in FIG. 9, second spacing member 906 connects third U-core 904 to first U-core 114 such that a gap 914 of relatively low magnetic permeability is formed between first and third U-cores 114 and 904. In alternative embodiments, second spacing member 906 may connect third U-core 904 to second U-core 116 such that a gap of relatively low magnetic permeability is formed between second and third U-cores 116 and 904. In the embodiment shown in FIG. 9, second spacing member 906 has substantially the same configuration has spacing member 118. In alternative embodiments, second spacing member 906 may have a configuration substantially the same as spacing member 518 shown in FIG. 5, or any other configuration that enables integrated magnetic assembly 900 to function as described herein.

Third winding 908 is inductively coupled to third U-core 904. Third winding 908 includes a fifth terminal side 916, a sixth terminal side 918, and an inductive section 920 interposed between fifth and sixth terminal sides 916 and 918. Inductive section 920 is recessed within third surface 910. In the embodiment shown in FIG. 9, integrated magnetic assembly 900 is particularly suited for use in high density power electronic circuits powered by a three-phase driver circuit configured to a supply a first current to first winding 104, a second current to second winding 106, and a third current to third winding 908, wherein the first, second, and third currents are each out of phase with one another by about 120 degrees.

Figure 10:
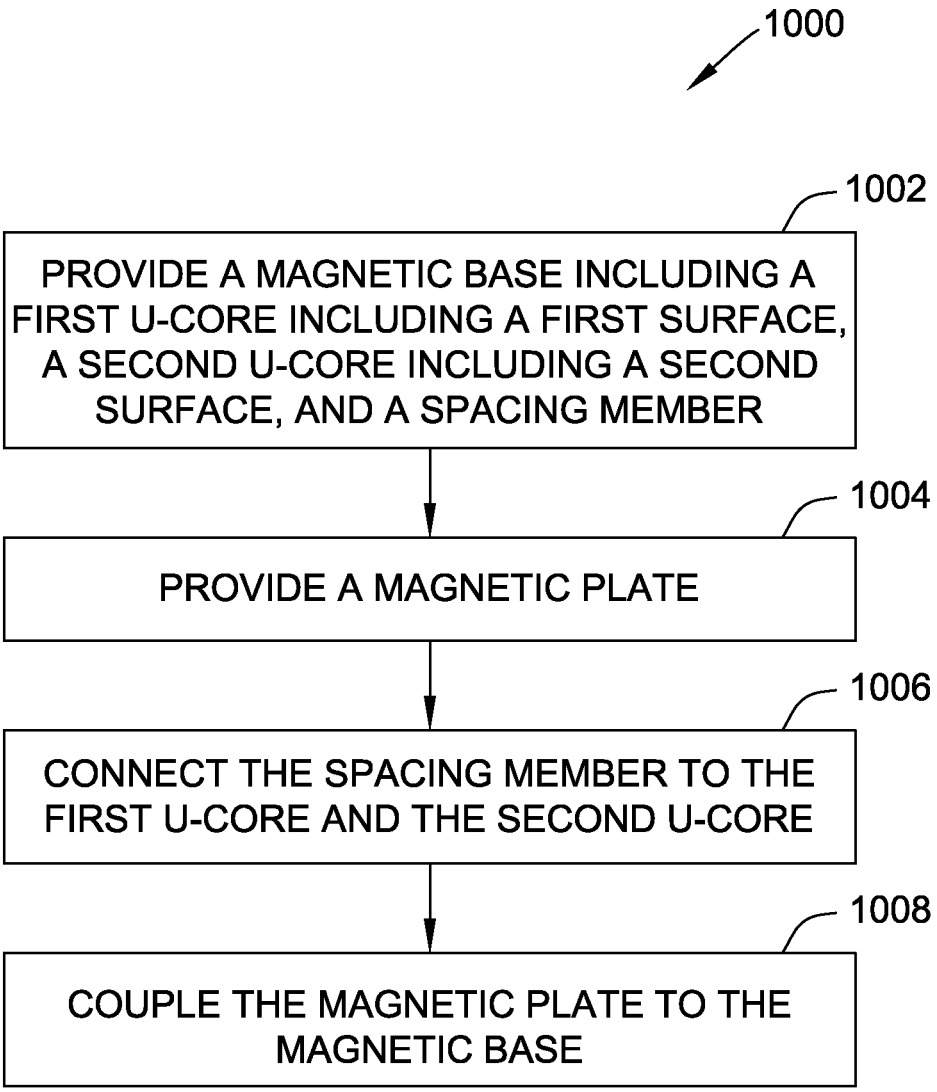
FIG. 10 is a flowchart of an exemplary method for assembling an integrated magnetic assembly.

FIG. 10 is a flowchart of an exemplary method 1000 of assembling an integrated magnetic assembly, such as integrated magnetic assembly 100 shown in FIG. 1. A magnetic base, such as magnetic base 110 is provided 1002. The magnetic base includes a first U-core including a first surface, a second U-core including a second surface, and a spacing member. A magnetic plate, such as magnetic plate 112 is provided 1004. The magnetic base and magnetic plate are included in a magnetic core. The spacing member is connected 1006 to the first U-core and the second U-core such that the first and second surfaces are substantially coplanar and a gap having a relatively low magnetic permeability is formed between the first and second U-cores. The magnetic plate is coupled 1008 to the magnetic base such that the magnetic plate substantially covers the first and second surfaces.

Exemplary embodiments of integrated magnetic assemblies are described herein. A magnetic core includes a magnetic base and a magnetic plate. The magnetic base includes a first U-core, a second U-core, and a spacing member. The first U-core has a relatively high magnetic permeability, and includes a first surface having a first winding channel defined therein. The second U-core has a relatively high magnetic permeability, and includes a second surface having a second winding channel defined therein. The first and second surfaces are substantially coplanar with one another. The spacing member is connected to the first and second U-cores such that a gap having a relatively low magnetic permeability is formed between the first and second U-cores. The magnetic plate is coupled to the magnetic base such that the magnetic plate substantially covers the first and second surfaces.

As compared to at least some integrated magnetic assemblies, in the systems and methods described herein, a magnetic core utilizes one or more spacing members configured to form a gap of relatively low magnetic permeability between multiple inductive cores within the magnetic core. Using a spacing member configured to form a gap of relatively low magnetic permeability between multiple inductive cores reduces the number of components needed to perform the same operations as compared to other integrated magnetic assemblies, and reduces the size of the integrated magnetic assembly, thereby increasing the maximum power density of the integrated magnetic assembly. Additionally, using a spacing member configured to form a gap of relatively low magnetic permeability between multiple inductive cores enables a more compact arrangement of inductive components that may be operated independently of one another. As a result, the position at which the windings enter and exit the integrated magnetic assembly can be easily modified to match the connection points of a given PWB, PCB, or other electronics board without affecting the independence of the inductive components.

Additionally, as compared to at least some integrated magnetic assemblies, in the systems and methods described herein, a magnetic core utilizes a unitary core for multiple inducting U-cores. Using a unitary core for multiple inductive cores provides better matching between the inductance of each core, thereby minimizing power losses and increasing the efficiency of the integrated magnetic assembly.

Additionally, as compared to at least some integrated magnetic assemblies, in the systems and methods described herein, a magnetic core utilizes a spacing member as a flux bridge between multiple inductive cores. Using a spacing member as a flux bridge between multiple inductive cores increases the inductance of at least one of the inductive cores under low current conditions, thereby reducing the likelihood of the integrated magnetic assembly entering a discontinuous phase (i.e., zero current phase).

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A magnetic core comprising:

a magnetic base comprising:

a first U-core having a relatively high magnetic permeability, said first U-core including a first surface having a first winding channel defined therein and a second surface having a second winding channel defined therein;

a second U-core having a relatively high magnetic permeability, said second U-core including a third surface having a third winding channel defined therein, wherein said first and third surfaces are substantially coplanar with one another and said second winding channel extends in a direction substantially perpendicular to said first and third surfaces and between said first and second U-cores; and a spacing member connecting said first and second U-cores such that a gap having a relatively low magnetic permeability is formed between said first and second U-cores, wherein said first and second U-cores are spaced from one another by said spacer; and a magnetic plate coupled to said magnetic base such that said magnetic plate substantially covers said first and third surfaces.

2. A magnetic core in accordance with claim 1, wherein at least one of said first and third winding channels is angled.

3. A magnetic core in accordance with claim 1 wherein at least one of said first and third winding channels is angled at an angle of between about 0 degrees and 90 degrees.

4. A magnetic core in accordance with claim 1, wherein at least one of said first and third winding channels is angled at an angle of between about 90 degrees and 180 degrees.

5. A magnetic core in accordance with claim 1, wherein said magnetic base further comprises:

a third U-core having a relatively high magnetic permeability, said third U-core including a fourth surface having a fourth winding channel defined therein, wherein said fourth surface is substantially coplanar with said first and third surfaces; and a second spacing member connecting said third U-core to one of said first and second U-cores such that a gap having a relatively low magnetic permeability is formed between said third U-core and one of said first and second U-cores.

6. A magnetic core in accordance with claim 1, wherein said spacing member is configured to provide a continuous magnetic flux path between said first and second U-cores.

7. A magnetic core in accordance with claim 1, wherein said magnetic base is a unitary magnetic base.

8. A magnetic core in accordance with claim 1, wherein said spacing member is constructed from a material having a relatively low magnetic permeability.

9. An integrated magnetic assembly comprising:

a magnetic core comprising:

a magnetic base comprising:

a first U-core having a relatively high magnetic permeability, said first U-core including a first surface and a second surface adjoining the first surface;

a second U-core having a relatively high magnetic permeability, said second U-core including a third surface, wherein said first and third surfaces are substantially coplanar with one another; and a spacing member connecting said first and second U-cores such that a gap having a relatively low magnetic permeability is formed between said first and second U-cores, wherein said first and second U-cores are spaced from one another by said spacer; and a magnetic plate coupled to said magnetic base such that said magnetic plate substantially covers said first and second surfaces;

a first winding including a first section recessed within said first surface and a second section recessed within said second surface and disposed between said first and second U-cores, wherein said first winding is inductively coupled to said first U-core; and a second winding including a third section recessed within said third surface, wherein said second winding is inductively coupled to said second U-core.

10. An integrated magnetic assembly in accordance with claim 9, wherein said first section of said first winding and said third section of said second winding are substantially coplanar with one another.

11. An integrated magnetic assembly in accordance with claim 9, wherein said first winding further includes a fourth section recessed within a fourth surface adjoining said first surface, wherein said second and fourth surfaces are different surfaces.

12. An integrated magnetic assembly in accordance with claim 9, wherein said first winding further includes a fourth section recessed within said second surface.

13. An integrated magnetic assembly in accordance with claim 9, wherein said magnetic core further comprises:

a third U-core having a relatively high magnetic permeability, said third U-core including a fourth surface substantially coplanar with said first and third surfaces; and a second spacing member connecting said third U-core to one of said first and second U-cores such that a gap having a relatively low magnetic permeability is formed between said third U-core and one of said first and second U-cores.

14. An integrated magnetic assembly in accordance with claim 13, further comprising a third winding recessed within said fourth surface, wherein said third winding is inductively coupled to said third U-core.

15. A method of assembling an integrated magnetic assembly comprising:

providing a magnetic base within a magnetic core, the magnetic base including a first U-core having a relatively high magnetic permeability, a second U-core having a relatively high magnetic permeability, and a spacing member, the first U-core including a first surface having a first winding channel defined therein and a second surface having a second winding channel defined therein, the second U-core including a third surface;

providing a magnetic plate within the magnetic core;

connecting the spacing member to the first U-core and the second U-core such that the first and third surfaces are substantially coplanar, the second winding channel extends between the first and second U-cores, and a gap having a relatively low magnetic permeability is formed between the first and second U-cores, the first and second U-cores spaced from one another by the spacer; and coupling the magnetic plate to the magnetic base such that the magnetic plate substantially covers the first and second surfaces.

16. A method in accordance with claim 15, further comprising:

providing a first winding including a first section, a second section, and a third section interposed between the first and second sections;

providing a second winding including a fourth section, a fifth section, and a sixth section interposed between the fourth and fifth sections;

inductively coupling the third section to the first surface of the first U-core; and inductively coupling the sixth section to the third surface of the second U-core.

17. A method in accordance with claim 16, further comprising coupling the second section of the first winding to the second surface of the first U-core, wherein the second surface is disposed between the first U-core and the second U-core, and the second section extends perpendicular to the first surface and between the first and second U-cores.

18. A method in accordance with claim 15, wherein the magnetic base further includes a third U-core having a relatively high magnetic permeability, the third U-core including a fourth surface, and a second spacing member, said method further comprising connecting the second spacing member to the third U-core and to one of the first and second U-cores such that the fourth surface is substantially coplanar with the first and third surfaces, and a second gap having a relatively low magnetic permeability is formed between the third U-core and one of the first and second U-cores.

19. A method in accordance with claim 18, further comprising:

providing a third winding including a seventh section, an eighth section, and a ninth section interposed between the seventh and eighth sections; and inductively coupling the ninth section to the fourth surface of the third U-core.

* * * * *

UNITED STATES PATENT AND TRADEMARK OFFICE

CERTIFICATE OF CORRECTION

PATENT NO. : 8,970,339 B2
APPLICATION NO. : 13/839519
DATED : March 3, 2015
INVENTOR(S) : Catalano It is certified that error appears in the above-identified patent and that said Letters Patent is hereby corrected as shown below:

In the specification

In Column 4, Line 25, delete "angle 3" and insert -- angle β --, therefor.

Signed and Sealed this
Twenty-seventh Day of October, 2015

Michelle K. Lee

Michelle K. Lee
*Director of the United States Patent and Trademark Office*